United States Patent [19]

Newman

[11] Patent Number: 4,805,767

[45] Date of Patent: Feb. 21, 1989

[54] PACKAGE SYSTEM

[76] Inventor: Duncan A. C. Newman, 78 Glendora Ave., Toronto, Ontario, Canada, M2N 2W1

[21] Appl. No.: 110,178

[22] Filed: Oct. 19, 1987

[30] Foreign Application Priority Data

Jun. 18, 1987 [CA] Canada ..... 540085

[51] Int. Cl.[4] ..... B65D 25/08

[52] U.S. Cl. ..... 206/219; 206/221

[58] Field of Search ..... 220/219, 221

[56] References Cited

U.S. PATENT DOCUMENTS

| | | | |
|---|---|---|---|
| 3,478,871 | 11/1969 | Sager | 206/221 |
| 3,539,794 | 11/1970 | Rauitut et al. | 206/211 |
| 3,542,032 | 11/1970 | Spencer, Jr. | 206/221 |
| 3,556,290 | 1/1971 | Clurman | 206/221 |
| 3,741,381 | 6/1973 | Thompson et al. | 206/221 |
| 4,458,811 | 7/1984 | Wilkinson | 206/221 |
| 4,509,642 | 4/1985 | Rowell | 206/221 |
| 4,537,308 | 8/1985 | Hollander, Jr. | 206/221 |
| 4,630,727 | 12/1986 | Feriani | 206/221 |

*Primary Examiner*—Joseph M. Moy
*Attorney, Agent, or Firm*—Michael M. Sakovich

[57] ABSTRACT

A pouch package system is fabricated from a compliant plastic film tube that includes a series of separate compartments formed by a plurality of transverse seals spaced along the tube. Contiguous pairs of compartments are mutually separated by means of the seals and are hermetically sealable for storing reactive materials under anaerobic conditions. A flexible narrow flattened conduit communicates each contiguous pair of compartments across the separating seal and comprises an unsealed portion in a common plane wherein the facing surfaces of the tube are joined. During storing of the materials the compartments are isolated by closing the conduit with a kink thereacross formed by a fold in the separating seal. Flattening the fold removes the kink to open the conduit. The separated materials are then combined and mixed by kneading the tube.

11 Claims, 4 Drawing Sheets

PACKAGE SYSTEM

FIELD OF THE INVENTION

This invention relates to a closure means in a pouch package system and to a compartmented pouch package system in which separated reactive materials are initially stored and subsequently processed under anaerobic conditions.

BACKGROUND OF THE INVENTION

Liquid resins that are curably set into solid form in the field of automobile body repair. Similar resins are also used in marine applications.

Auto body fillers, marine fillers, and like products constitute a blend of uncured polyster resin, a cobalt accelerator and one or more fillers such as talc, titanium dioxide, glass microspheres, glass fibers and the like. Conventionally, the resin is packaged in a can and a separate smaller container of catalyst is provided for addition thereto. In preparation for use, a predetermined amount of resin is deposited on a clean, flat mixing surface or in a separate mixing container. The catalyst is then added in correct proportion to the amount of resin used.

The catalyst may be an oxidizing agent such as methyl ethyl ketone (MEK) peroxide or benzoyl peroxide that is usually supplied as a liquid in a small bottle or tube. Alternatively, the catalyst may be in the form of a paste stored in a squeeze tube. In the case of the liquid, added drops of catalyst are counted whereas in the paste form, a squeezed out ribbon of catalyst is measured to ensure that a correct proportion of catalyst is added to the resin. Both are manually mixed to obtain a uniform blend. The product is then applied to a work surface such as a dent in an automobile body and is smoothed to an appropriate contour in the few minutes available to a user before the resin polymerizes to a state where it cannot be worked.

Adequate ventilation is essential to avoid the harmful effects of volatile styrene monomer which is a toxic component in polyester resin. Although industrial health standards may be observed in well organized workshops, it is not likely that independent users would take the time or trouble to observe proper safety precautions in terms of adequate ventilation. The health of such users is therefore at risk.

Accurate control of the resin-catalyst ratio is important to achieve maximum working time of the blended resin as well as optimum strength in the hardened product. Thus, a distraction may easily lead to error when counting drops of catalyst which may result in a poor product. Extensive reworking may even be required resulting in wasted time and materials as a consequence of an incorrect ratio of resin and catalyst.

Mixing the catalyst and resin under aerobic conditions results in air bubbles that are entrained in the mixed product. When the cured resin is worked as by filing and sanding, the bubbles appear as pinholes in the finished surface which requires the further application of a skin coat of body filler or putty to provide an acceptable finished surface suitable for painting.

Tools, surfaces and containers used in mixing the resin and catalyst require laborious cleaning prior to subsequent use or else they must be discarded after polymerization of the resin occurs. Either case entails an expense that is quite likely to be substantial in commercial use having regard to the fact that material quantities may only be mixed in small batches in view of a short available working time. This characteristic in particular indicates a need for a cost effective package system since small batch usage dictates large quantity production runs.

Some of the foregoing problems associated with volatile resins and catalysts have been addressed more or less successfully in the art of compartmented receptacles.

An example of a package having a plurality of compartments suitable for storing and mixing reactive substances is disclosed in U.S. Pat. No. 2,756,874 Erickson et al. In one embodiment, the package comprises a flattened plastic film tube having open ends that are heat sealed closed. The sealed tube is further closed off into a dual compartment bag by means of a fold arrangement placed transversely of the tube between the ends. This fold arrangement includes a resilient core member made from rope, cellulose matter, or the like that extends transversely across the tube along one exterior side. The tube walls are wrapped partially around the member so that the inside surfaces of both walls come into contact. A flexible clamp engages the tube walls and grips same against the core member to effect an openable seal between compartments. Means are provided for filling the compartments, excluding air, and a relief strip is positioned between the walls and clamp to facilitate clamp removal without tearing the package.

Another example is a multiple chambered container made to separate liquid epoxy resins from a suitable hardener until the epoxy is to be used which is disclosed in U.S. Pat. No. 2,916,197 Detrie et al. The peripheral edges of a plastic bag are heat sealed shut and respective epoxy and hardener chambers are separated by one of a variety of internal dividing means that include a heat seal, a thin membrane, an adhesive, or a pair of opposed mating closure members. The epoxy and hardener mix when the dividing means are breached and the bag is kneaded. The bag contents are subsequently dispensed through a corner of the bag which is cut away.

Still another example appears in U.S. Pat. No. 3,462,070 Corella which discloses a dual compartment flexible bag fabricated from tubular, heat sealable plastic film. An openable closure is disposed across the tube intermediate both open ends. Two compartments are thus formed into which a separate reactive product is added followed by closure of the open ends as by heat sealing across the tube. At least one fold in the opposing side walls of the tube is lightly heat sealable to form the openable closure which is opened to mix the reactive products. Pulling the sealed tube ends in opposite directions straightens the fold by breaking an outer light heat seal which is then followed by squeezing one compartment to pressurize same. As a result, an inner light heat seal is broken and the closure is opened.

The bags of Erickson et al, Detrie et al and Corella are discarded after initial use and are intended to be produced in large quantities. Economy of manufacture is therefore an important criterion.

However, the disclosure in Erickson et al of an openable closure comprising a core member, a removable clamp and a relief strip which is added to the principal structure of a dual compartment flat bag appears to be greater in cost than the bag per se. The absence of a cost effective package is therefore clearly apparent.

The disclosure in Detrie et al of internal dividing or a pair of opposed mating closure members also indicates a relatively expensive bag structure that is not cost effective.

Similarly in Corella, the openable closure that requires lightly heat sealing a plurality of folded layers in each bag for about five seconds is a costly process by virtue of excessive machine time that results in an unnecessarily expensive disposable bag. Additional cost is incurred as a result of required extra adhesive when laminated plastic film is used.

Another shortcoming in the aforenoted prior art relates to the common teaching of breaching a barrier in a two compartment package and mixing the respective components thereof in both compartments. This is unsuitable when the mixing ratio of the respective components is disproportionate, resulting in loss of process control for varying reaction temperatures and desired hardening times.

Neither Erickson et al nor Corella refer to laminated films, only single layer films being disclosed, whereas laminates are necessary in packaging requiring toughness, an effective vapor barrier and heat sealability.

Common to the aforenoted prior art is the teaching of a seal between adjacent compartments that completely traverses the package. The extra length of such a seal increases the probability of premature leakage between compartments.

Still another shortcoming in the prior art are the "weak bonds" disclosed in Corella which will not function in the presence of polyster resin that attacks the laminate bond and leads to delamination. Also, since laminated plastic films cannot be heat sealed on their outer surface, Corella's folded layers require adhesive as noted hereinabove.

SUMMARY OF THE INVENTION

A principal objective of the present invention is to provide a cost effective disposable package system that is adapted for storing and subsequently mixing a plurality of materials that are separately contained therein.

Another provision of the invention is a laminated film package system having separate chambers in which individual ones of reactive materials may be hermetically sealed.

Still another provision of the invention is a package system in which the stored materials may be mixed under anaerobic conditions.

Yet another provision of the invention is accurate control of the resin-catalyst ratio via a narrow feeding conduit.

A further provision of the invention is a package system providing closed mixing of toxic materials contained therein to lessen user exposure thereto.

Yet another provision of the invention is a package system that avoids the need for mixing tools and implements.

The problems associated with the prior art may be substantially overcome and the foregoing objectives achieved by recourse to my invention which is a package system for #miming together a plurality of materials separately contained 1 in hermetically sealed relation. The system comprises primary pouch means having compliant side walls defining a first storage chamber, secondary pouch means having like side walls defining a second storage chamber contiguous with the first chamber and communicably separated therefrom along a common boundary, conduit means communicating the first and second chambers across the common boundary, and means for openably closing the conduit means to initially isolate the respective chambers for storing the materials therein and subsequently controllably intercommunicating said chambers for combining the separated materials and mixing same by kneading the side walls.

BRIEF DESCRIPTION OF THE DRAWINGS

The invention will now be more particularly described with reference to embodiments thereof shown, by way of example, in the accompanying drawings wherein:

FIG. 7 is a perspective view of a clip usable in maintaining the fold in the embodiment of FIG. 1*a.

DESCRIPTION OF THE ILLUSTRATED EMBODIMENTS

Having regard to the illustrated embodiments of the invention and the descriptions thereof which follow, it will be observed that certain structural features are common. In order that continuity of structure may be readily recognized in the various embodiments, like numerals are used to designate like structural features as they are described.

Figure 1A:
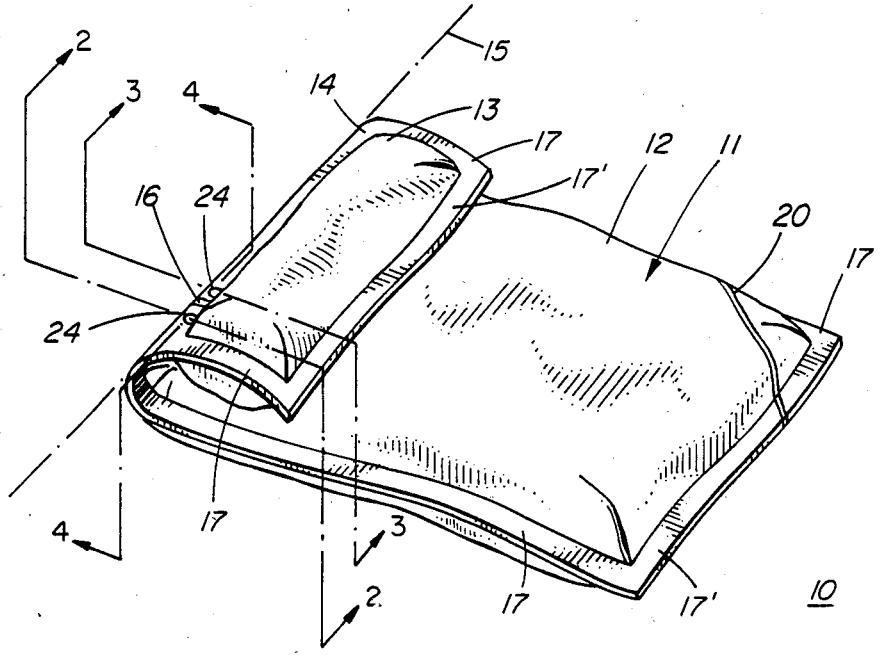
FIG. 1*a* is a perspective view of one embodiment of a package system according to the present invention showing a secondary pouch folded over and overlying a portion of a primary pouch.

A package system in accordance with the present invention is illustrated in FIG. 1*a* as a package 10 having flattened compliant side walls, shown generally as side walls 11, which define a primary pouch 12 and a secondary pouch 13 that are contiguously joined along a common boundary 14. According to FIG. 1*a*, the pouch 13 is shown folded over so as to overlie a portion of the pouch 12. The fold occurs symmetrically about an axis 15 which is best seen in FIG. 1*b*.

Figure 1B:
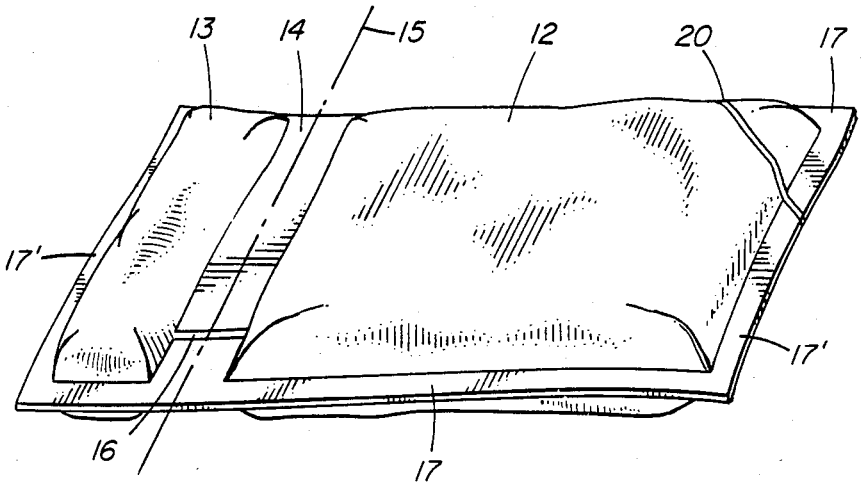
FIG. 1*b* is another perspective view of the embodiment of FIG. 1*a* showing the first and second pouches unfolded.
Figure 1C:
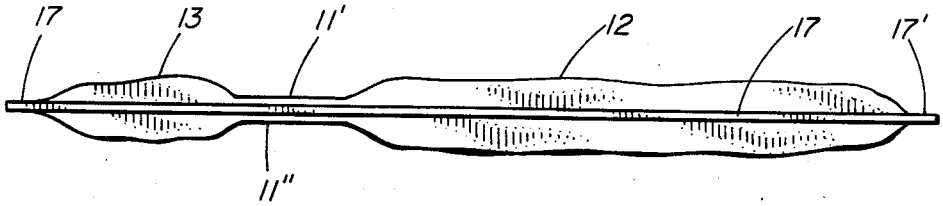
FIG. 1*c* is a side elevation view of the embodiment shown in FIG. 1*b;*

Regarding FIG. 1*b*, it will be understood that the walls 11 which form opposite sides of each pouch are sealingly joined together as by ultrasonic welding, heat sealing and adhesive bonding. Irrespective of the method used, the facing side walls 11 are joined along the boundary 14, except for a flexible narrow conduit 16 that intercommunicates the pouches 12 and 13, and along a circumscribing boundary 17 and 17'

An optional feature of the package 10 in FIGS. 1*a* and 1*b* is a notch (not shown) or a weakened portion 20 in the walls 11. It will be understood that a like weakened portion 20 is formed in each facing wall 11, diagonally positioned across one corner, to facilitate removal thereof by tearing the corner free. A discharge opening is thus provided for the pouch 12.

The conduit 16 is initially closed to isolate the respective chambers of the pouches 12 and 13 as when storing an uncured polyester resin 21 in the pouch 12 and a catalyst such as MEK peroxide 22 in the pouch 13. Subsequently, the conduit 16 is opened to intercommunicate the respective chambers of the pouches 12 and 13 so that the peroxide 22 may be squeezed from the pouch 13 into the pouch 12 to mix with the resin 21. Anaerobic mixing is achieved by ensuring that air is excluded from the pouches 12 and 13 when the resin 21 and peroxide 22, respectively, are added. Since the walls 11 are hermetically sealed, air may not subsequently enter.

In accordance with the invention, the conduit 16 is openably closeable by folding the pouch 13 so that it overlies a portion of the pouch 12 as illustrated in FIG. 1*a*. Being folded about the axis 15 causes the conduit 16 to be pinched or kinked closed as illustrated in the cross sectional view of FIG. 3, the closed portion of the conduit 16 being shown in a region 23 in which facing walls 11' and 11'', that define the conduit 16, are in mutual contact. Since this area of mutual contact is effectively closed, as determined by the kink in the folded conduit 16, the catalyst 22 will not leak through to polymerize the resin 21 until the pouch 13 is unfolded as illustrated in FIG. 1*b* and the peroxide 22 is squeezed through the conduit 16 by squeezing together the facing walls 11 of the pouch 13 to generate an internal hydrostatic pressure.

Having thus forced a predetermined quantity of the peroxide 22 into he pouch 12, anaerobic mixing and blending of the peroxide 22 and the resin 21 may proceed by kneading the walls 11 of the pouch 12. Although not indicated in the drawings, it will be understood that a color change may occur in the mixture to indicate the state of blending by including colorants that are well known to those skilled in the art. Similarly, other colorants may be added to indicate the degree of polymerization. To facilitate viewing such color changes the walls 11 would be preferably transparent and colorless. This may be inadequate, however, for ultraviolet protection.

Figure 2:
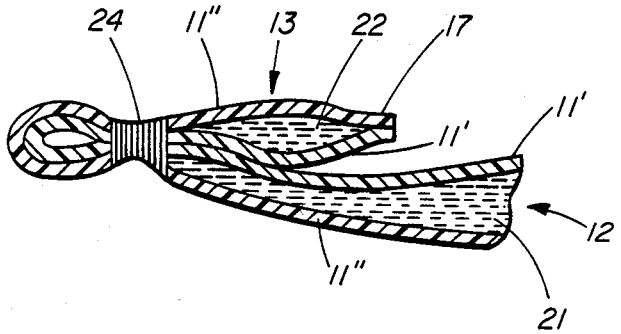
FIG. 2 is a cross sectional view of FIG. 1*a* taken along the lines 2—2.

Having closed the conduit 16 by kinking as described herein, it is essential that the conduit remain securely folded to maintain closure. Various means are available to maintain the fold illustrated in the drawings. Firstly, reference to the cross sectional view of FIG. 2 shows one of two spotwelds 24. One weld is disposed on either side of the conduit 16 as may be seen in FIG. 1*a*. The welds 24 may be conventionally produced by the application of external heat, the use of an ultrasonic welding technique, or by applying a bonding adhesive to the contacting surfaces of the wall 11' shown in FIG. 2. In every instance, the conduit 16 is opened by pulling the pouches 12 and 13 so as to rip apart the welds 24 or the adhesive. The pouch 13 will then be unfolded with the conduit unkinked so as to intercommunicate the pouches 12 and 13.

Figure 4:
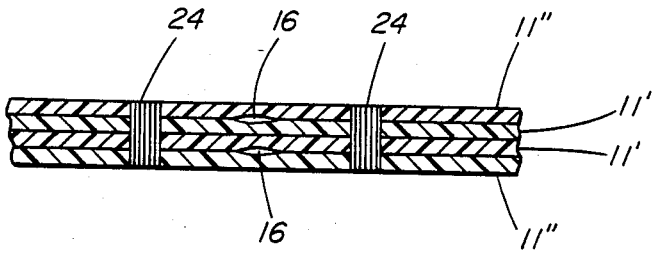
FIG. 4 is a cross sectional view of FIG. 1*a* taken along the lines 4—4.

The cross sectional view of FIG. 4 illustrates the disposition of the welds 24 on either side of the conduit 16 as seen along section lines 4—4 of FIG. 1*a*.

Figure 7:
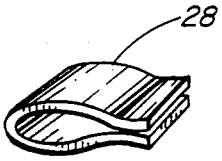

Another means by which the pouch 13 may be retained in a folded condition about the axis 15 is to hold the folded boundary 14 in place using a clip 28 as illustrated in FIG. 7. The clip 28 is shown to be relatively short in length which is in accord with my invention, namely, that the conduit 16 being narrow is securely closed by kinking as heretofore described. I have discovered that a wide conduit, substantially as wide as the pouches 12 and 13, is difficult to openably close effectively, whereas a narrow flexible conduit is readily and securely closed by pinching or kinking the conduit via a fold formed thereacross.

The clip 28 is typically fabricated from steel, aluminum or plastic. In any event, the material from which the clip 28 is fabricated must exert a constraining force sufficient to maintain the boundary 14 folded across the conduit 16.

Figure 3:
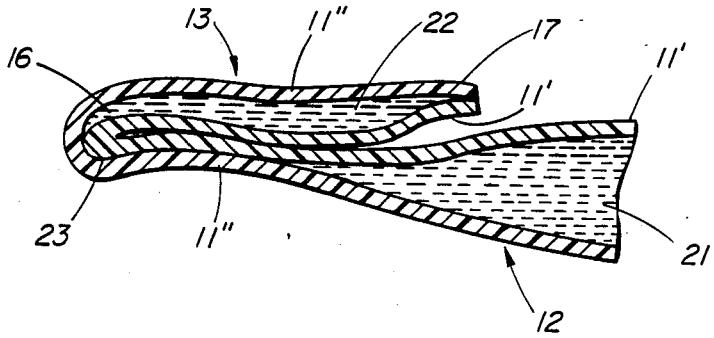
FIG. 3 is a cross sectional view of FIG. 1*a* taken along the lines 3—3.
Figure 6:
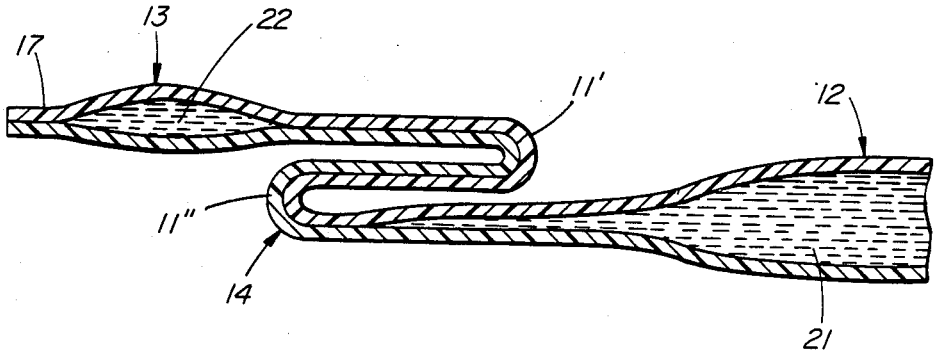
FIG. 6 is a cross sectional view corresponding to the view of FIG. 3 but showing a dual fold between pouches.

FIG. 6 illustrates a cross sectional view corresponding to the view of FIG. 3 but showing a double fold in the boundary 14. The purpose of the double fold is to form a second kink in the conduit 16 and to increase the distance over which the facing walls 11' and 11'' make contact, thereby providing a longer path to minimize the possibility of leakage between the pouches 12 and 13. In this arrangement, the double bend configuration may be retained by welding or by the application of a bonding adhesive as previously described.

The walls 11 cannot be merely a polyolefin or vinyl film. Although such films are easy to seal, they are not suitable since the volatile components of the resin and catalyst can readily diffuse through these plastics. An example of a preferred film is multilaminate film of mylar or nylon, which functions as a barrier layer, bonded with a suitable adhesive to a medium density polyethylene and/or polypropylene which functions as a sealing layer of the pouches 12 and 13. Such multilaminate films are employed by the Fibre-Glass Evercoat Company of Cincinnati, Ohio, for pouch packaging of uncured polyester resin alone. Other suitable multilaminate films may contain acrylonitrile. One such film is sold under the trade mark BAREX by the Standard Oil Company of Ohio.

Another multilaminate film suitable in the present invention would be a good quality laminate of the type used in food packaging. The main criterion in selecting a film to fabricate the package 10 is extended shelf life without delamination or breaching or undue product evaporation or oxidation.

In order to simplify illustrating and describing the embodiments of the invention, various figures are shown in which the pouches 12 and 13 are fabricated from unitary films that form the walls 11' and 11''. This was done with the understanding that such films, e.g., nylon, meet the criterion of ability to heat seal together as well as providing an adequate diffusion resistant barrier to the volatile components in the resin 21 and the catalyst 22. Note however that whereas the use of separate films entails the formation of the entire boundary 17, employment of a coextruded laminated transverse seals that separate adjacent packages 10 and pouches 12 and 13.

Figure 5:
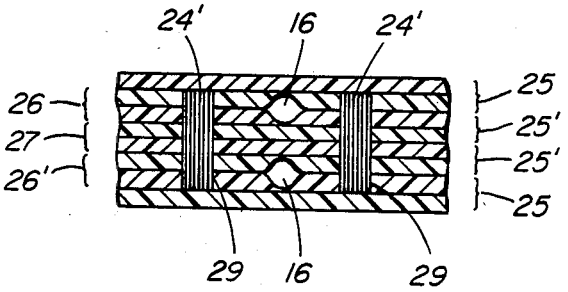
FIG. 5 is a cross sectional view similar to the embodiment of FIG. 4 but showing each pouch side wall comprising dual laminae.

Referring next to FIG. 5 there is shown a cross sectional view that would be seen along the section lines 4—4 of FIG. 1*a* when the walls 11' and 11'' are fabricated from a double laminate film of the type described, i.e., having a heat sealable lamina and a barrier lamina that is not heat sealable.

Comparing FIG. 5 with FIG. 4, it will be seen that each lamina comprising walls 11'' and 11' of FIG. 4 is substituted with a double laminated film 25 and 25', respectively, in FIG. 5. Having regard to FIGS. 1*a*, 2 and 4, it will be understood that the film 25 corresponds to the walls 11'' in FIG. 2 whereas the film 25' corresponds to the walls 11' of the same figure.

In order to effect hermetic sealing between facing pairs of films 25 and 25', it will be observed in FIG. 5 that each one of these films includes a heat sealable laminate shown in mutual contact as laminate pairs 26 and 26'. It will be further observed, however, that a pair of barrier films 27 are also in mutual contact, although heat sealing therebetween is not feasible. Forming a continuous heat seal bond between the opposing films 25 through the barrier films 27 to maintain the fold between the pouches 12 and 13, requires that the film 25' be apertured as at 29. Accordingly, when the pouch 13 is folded as illustrated in FIG. 1*a*, the apertures 29 (FIG. 5) are aligned to permit a flow of heat sealable material therethrough between the laminate pairs 26 and 26' to effect welds 24' corresponding to welds 24 in FIG. 4.

The conduit 16 portions, shown in FIG. 5, have not been drawn to scale in an effort to more clearly show the formation of these portions when laminate pairs 26 and 26 of adjacent facing films 25 and 25' are heat sealed together along the boundary 14.

Figure 8:
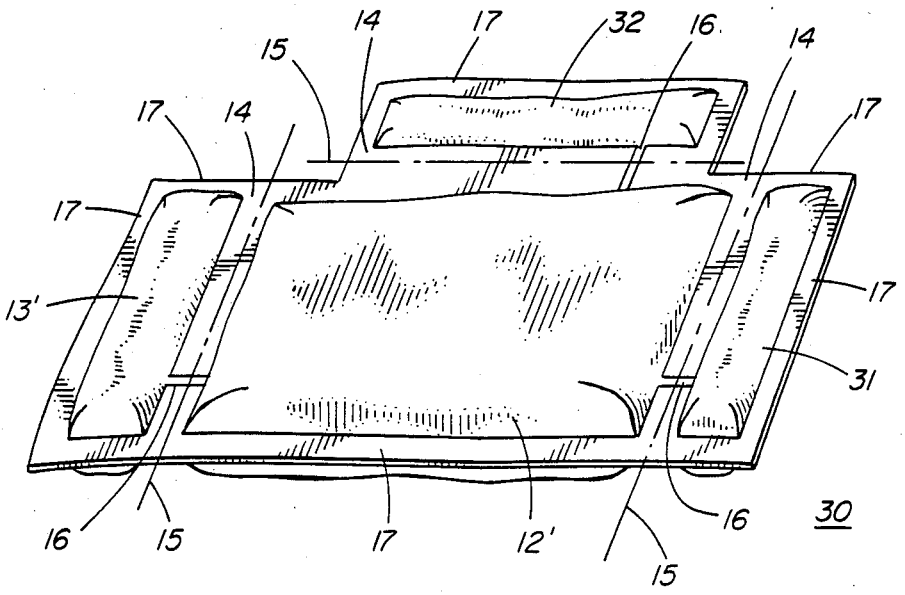
* and FIG. 8 is a perspective view of another embodiment of a package system in accordance with the present invention.

FIG. 8 is illustrative of another embodiment of the present invention showing a multipouch package 30 containing pouches 12' and 13' together with additional pouches 31 and 32. Although the embodiment of FIG. 8 contains more pouches than usually required in a two component reactive system of the type used in automobile body fillers, the embodiment of FIG. 8 would find application in other systems, e.g., mixing medical agents together before administering to a patient.

It will be apparent, therefore, to those skilled in the art, that the aforedescribed embodiments may be varied to meet particular specialized requirements without departing from the true spirit and scope of the invention disclosed. These embodiments are therefore not to be taken as indicative of the limits of the invention but rather as exemplary structures thereof which is defined by the claims appended hereto.

The embodiments of the invention in which an exclusive property or privilege is claimed are defined as follows:

1. A package system for mutually mixing a plurality of materials separately contained in hermetically sealed relation, comprising in combination:

pouch means having compliant side walls comprising a pair of facing coplanarly disposed film strips each including a heat sealable interior lamina and a non-heat sealable exterior lamina coplanarly bonded thereto, the interior laminae being heat sealed along a common boundary and adjacent the peripheral edges thereof to define first and second storage chambers in the form of a flattened tube, the exterior laminae being substantially impervious to the respective vapors of the materials stored in the chambers and to the effects of ambient air from without on such materials, and the common boundary comprising a portion transverse to the long axis of the tube wherein the facing surfaces of the interior laminae are sealed together in a common plane with an unsealed portion defining a flexible narrow flattened conduit communicating the chambers across the common boundary;

a fold formed in the common boundary, said fold being disposed on a line placed transversely of the conduit for closing same by forming a king thereacross to initially isolate the respective chambers for storing the materials therein and subsequently opening the conduit by flattening the fold to remove the kink and intercommunicating said chambers for controllably combining the separated materials and mixing same by kneading the side walls; and at least one aperture disposed in one strip on each side of the fold line such that corresponding pairs of apertures enter into registry within the fold, whereby the heat sealable lamina of the other strip is communicable through the corresponding pairs of apertures to permit heat sealing therethrough for maintaining the fold to effect closure of the conduit.

2. A package system as claimed in claim 1 wherein the heat seals formed through the apertures are forcibly separable to flatten the fold for opening the closed conduit.

3. A package system as claimed in claim 2 wherein each film strip comprises a food packaging laminate.

4. A package system as claimed in claim 2 wherein the film strips defining the first storage chamber include weakened portions adapted to be torn free from the system to provide a discharge opening for the mixed materials.

5. A package system as claimed in claim 2 wherein the interior laminae comprise one of, polyolefin, vinyl and acrylonitrile.

6. A package system as claimed in claim 5 wherein the exterior laminae comprise one of, mylar, nylon, acrylonitrile and Saran.

7. A package system as claimed in claim 6 wherein the film strips comprise a multilaminate film including one of, mylar, nylon and aluminum foil adhesively bonded to one of, a medium density polyethylene and polypropylene.

8. A package system as claimed in claim 7 wherein the multilaminate film is substantially transparent to permit viewing a color change proportional to the degree of mixing two reactive materials.

9. A package system as claimed in claim 17 wherein the reactive materials comprise a polyester resin and a catalyst therefor.

10. A package system as claimed an claim 18 wherein the catalyst comprises an oxidizing agent including one of methyl ethyl ketone peroxide and benzoyl peroxide.

11. A package system for mutually mixing a plurality of materials separately contained in hermetically sealed relation, comprising in combination:

pouch means having compliant tubular side walls comprising a heat sealable interior lamina and a coextruded non-heat sealable exterior lamina, the interior lamina being heat sealed along a common boundary thereof to define first and second storage chambers in the form of a flattened tube with heat sealable open ends, the exterior lamina being substantially impervious to the respective vapors of the materials stored in the chambers and to the effects of ambient air from without on such materials, and the common boundary comprising a portion transverse to the long axis of the tube wherein the facing surfaces of the interior lamina are sealed together in a common plane with an unsealed portion defining a flexible narrow flattened conduit communicating the chambers across the common boundary;

a fold formed in the common boundary, said fold being disposed on a line placed transversely of the conduit for closing same by forming a kink thereacross to initially isolate the respective chambers for storing the materials therein and subsequently opening the conduit by flattening the fold to remove the kink and intercommunicating said chambers for controllably combining the separated materials and mixing same by kneading the side walls; and at least one aperture disposed in the tubular side walls on each side of the fold line such that corresponding pairs of apertures enter into registry within the fold, whereby the heat sealable lamina is communicable through the corresponding pairs of apertures to permit heat sealing therethrough for maintaining the fold to effect closure of the conduit.

* * * * *